US012123677B2

(12) United States Patent
Binder et al.

(10) Patent No.: US 12,123,677 B2
(45) Date of Patent: Oct. 22, 2024

(54) CAPACITY LIMITING ASSEMBLY FOR MAGAZINES, MAGAZINES HAVING LIMITED CAPACITY, AND RELATED METHODS

(71) Applicant: Lancer Systems LP, Quakertown, PA (US)

(72) Inventors: Jared Binder, Wind Gap, PA (US); Joshua Welsh, Coopersburg, PA (US); William Lutton, Quakertown, PA (US)

(73) Assignee: Lancer Systems LP, Quakertown, PA (US)

( * ) Notice: Subject to any disclaimer, the term of this patent is extended or adjusted under 35 U.S.C. 154(b) by 0 days.

(21) Appl. No.: 17/381,558

(22) Filed: Jul. 21, 2021

(65) Prior Publication Data

US 2022/0357121 A1 Nov. 10, 2022

Related U.S. Application Data

(60) Provisional application No. 63/059,586, filed on Jul. 31, 2020.

(51) Int. Cl.
*F41A 9/71* (2006.01)

(52) U.S. Cl.
CPC ..... *F41A 9/71* (2013.01)

(58) Field of Classification Search
CPC ..... F41A 9/71
(Continued)

(56) References Cited

U.S. PATENT DOCUMENTS 8,713,835 B1 5/2014 Calvert
8,752,317 B1 6/2014 Calvert
(Continued)

FOREIGN PATENT DOCUMENTS

WO WO 03046466 A1 6/2003

*Primary Examiner* — Reginald S Tillman, Jr.
(74) *Attorney, Agent, or Firm* — Calderone McKay LLC

(57) ABSTRACT

The invention relates to a capacity limiting assembly that provides substantially irreversible alteration of a box magazine to limit its cartridge capacity wherein the box magazine comprises a magazine housing having a vertical dimension $Y_M$, a magazine spring having at least 1 coil, and a follower. The assembly includes a limiter body and a lock plate. The limiter body has a top edge engageable with a bottom surface of the follower that is operatively associated with a top of the magazine spring extending into the cartridge reservoir and is configured to be disposed substantially within the at least one coil of the magazine spring. The limiter has a vertical dimension $Y_L$ that is less than the vertical dimension $Y_M$ of the magazine housing, and a limiter bottom edge that is engageable to a lock plate. The lock plate of the assembly has a top surface engageable to the bottom surface of the limiter body and bottom surface engageable to the lock plate of the magazine when the lock plate is placed against a bottom edge of the magazine housing. When a top surface of the lock plate is bonded to the limiter body, the limiter substantially irreversibly reduces the capacity of the box magazine. Also included are magazines fitted with the assembly and related methods of reducing the capacity of magazines.

12 Claims, 7 Drawing Sheets

(58) Field of Classification Search
USPC ..... 42/49.02
See application file for complete search history.

(56) References Cited

U.S. PATENT DOCUMENTS

| | | | | |
|---|---|---|---|---|
| D718,406 | S | 11/2014 | Mayberry et al. | |
| D718,834 | S | 12/2014 | Mayberry et al. | |
| 9,267,749 | B1 | 2/2016 | Dukart | |
| 9,328,982 | B2 * | 5/2016 | Ladner | F41A 9/71 |
| 9,435,607 | B1 | 9/2016 | Moushon et al. | |
| 9,488,426 | B2 | 11/2016 | Ladner | |
| 10,041,752 | B2 | 8/2018 | Ladner | |
| 10,066,886 | B2 | 9/2018 | Vilardi et al. | |
| 2012/0246988 | A1 | 10/2012 | Ladner | |
| 2013/0086834 | A1 | 4/2013 | Battaglia | |
| 2013/0192115 | A1 | 8/2013 | Calilung | |
| 2013/0247437 | A1 | 9/2013 | Obermeit | |
| 2014/0352189 | A1 | 12/2014 | Fitzpatrick et al. | |
| 2015/0316340 | A1 | 11/2015 | Ladner | |
| 2019/0310040 | A1 | 10/2019 | Ladner et al. | |
| 2020/0096272 | A1 | 3/2020 | Brown et al. | |
| 2020/0173745 | A1 | 6/2020 | Fazer | |

* cited by examiner

CAPACITY LIMITING ASSEMBLY FOR MAGAZINES, MAGAZINES HAVING LIMITED CAPACITY, AND RELATED METHODS

CROSS REFERENCE TO RELATED APPLICATION

This application claims the benefit under 35 U.S.C. § 119(e) to U.S. Provisional Patent Application No. 63/059,586, filed Jul. 31, 2020, the entire disclosure of which is incorporated herein by reference.

BACKGROUND OF INVENTION

Since the earliest gunpowder activated weapon, the fire lance developed in China in the $10^{th}$ century, firearms makers have continuously innovated to\increase the accuracy, effectiveness, reliability, and safe operation of firearms weapons. In some instances, such innovations are driven by legislation—for example, laws passed placing restrictions on firearm capacity or structure.

Recently in many jurisdictions, laws have been enacted that limit the capacity of firearm magazines. To adjust to the rule of law, firearms makers have made efforts to create assemblies and other devices that limit or restrict the existing capacity of a cartridge magazine. Prior art attempts include installation of a rivet in the side of the magazine to limit the downward travel of the cartridge follower; installation of a block within the cartridge space of an existing magazine; and/or modification of the followers.

Thus far, all the prior art attempts suffer various disadvantages. For example, they may render the magazine's cartridge feeding capacity unreliable or decrease its lifespan by increasing wear-and-tear on the magazine component parts. Nor are the prior art attempts to limit capacity irreversible, and therefore these modifications remain non-complaint in jurisdictions that require magazine limiting modifications to be substantially permanent.

Therefore, there remains in the art a need for improved capacity-limiting assemblies that provide substantially irreversible modification and thus comply with applicable laws and regulations, without compromising the overall reliability of the magazine.

BRIEF SUMMARY OF THE INVENTION

Included within the scope of the invention is a capacity limiting assembly that provides substantially irreversible alteration of a box magazine to limit its cartridge capacity wherein the box magazine comprises a magazine housing having a vertical dimension $Y_M$, a magazine spring having at least 1 coil, and a follower. The assembly includes a limiter body and a lock plate. The limiter body has a top edge engageable with a bottom surface of the follower that is operatively associated with a top of the magazine spring extending into the cartridge reservoir and is configured to be disposed substantially within the at least one coil of the magazine spring. The limiter has a vertical dimension $Y_L$ that is less than the vertical dimension $Y_M$ of the magazine housing, and a limiter bottom edge that is engageable to a lock plate. The lock plate of the assembly has a top surface engageable to the bottom surface of the limiter body and bottom surface engageable to the lock plate of the magazine when the lock plate is placed against a bottom edge of the magazine housing. When a top surface of the lock plate is bonded to the limiter body, the limiter substantially irreversibly reduces the capacity of the box magazine.

Also included are magazines fitted with the assembly and related methods of reducing the capacity of magazines.

BRIEF DESCRIPTION OF THE SEVERAL VIEWS OF THE DRAWING(S)

The foregoing summary and the following detailed description of preferred embodiments of the invention may be better understood when read in conjunction with the appended drawings. For the purpose of illustrating the invention, there is shown in the drawings embodiments which may be presently preferred. The invention is not limited to the precise arrangements and instrumentalities shown. In the drawings.

DETAILED DESCRIPTION OF THE INVENTION

Figure 1:
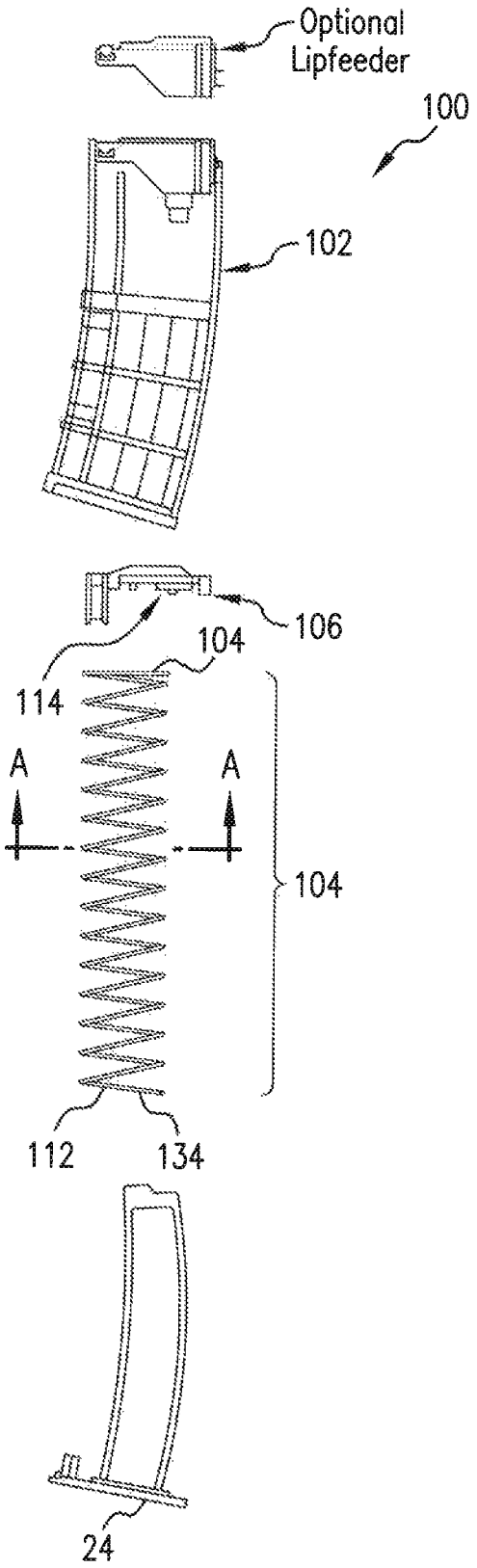
FIG. 1 is an exploded view of a magazine including the assembly of the invention.
Figure 2:
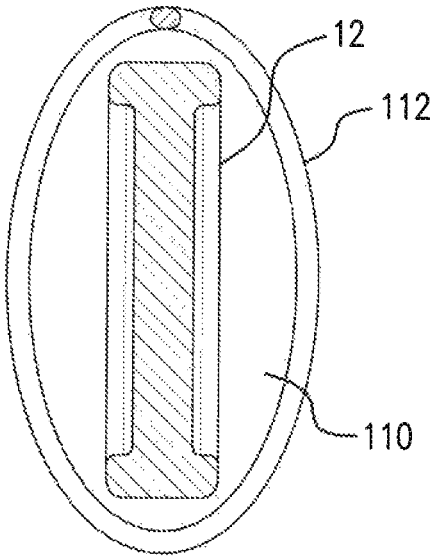
FIG. 2 is a cross sectional view taken at section A-A of FIG. 1 showing the limiter body disposed within an area defined by the coils of the magazine spring.
Figure 3:
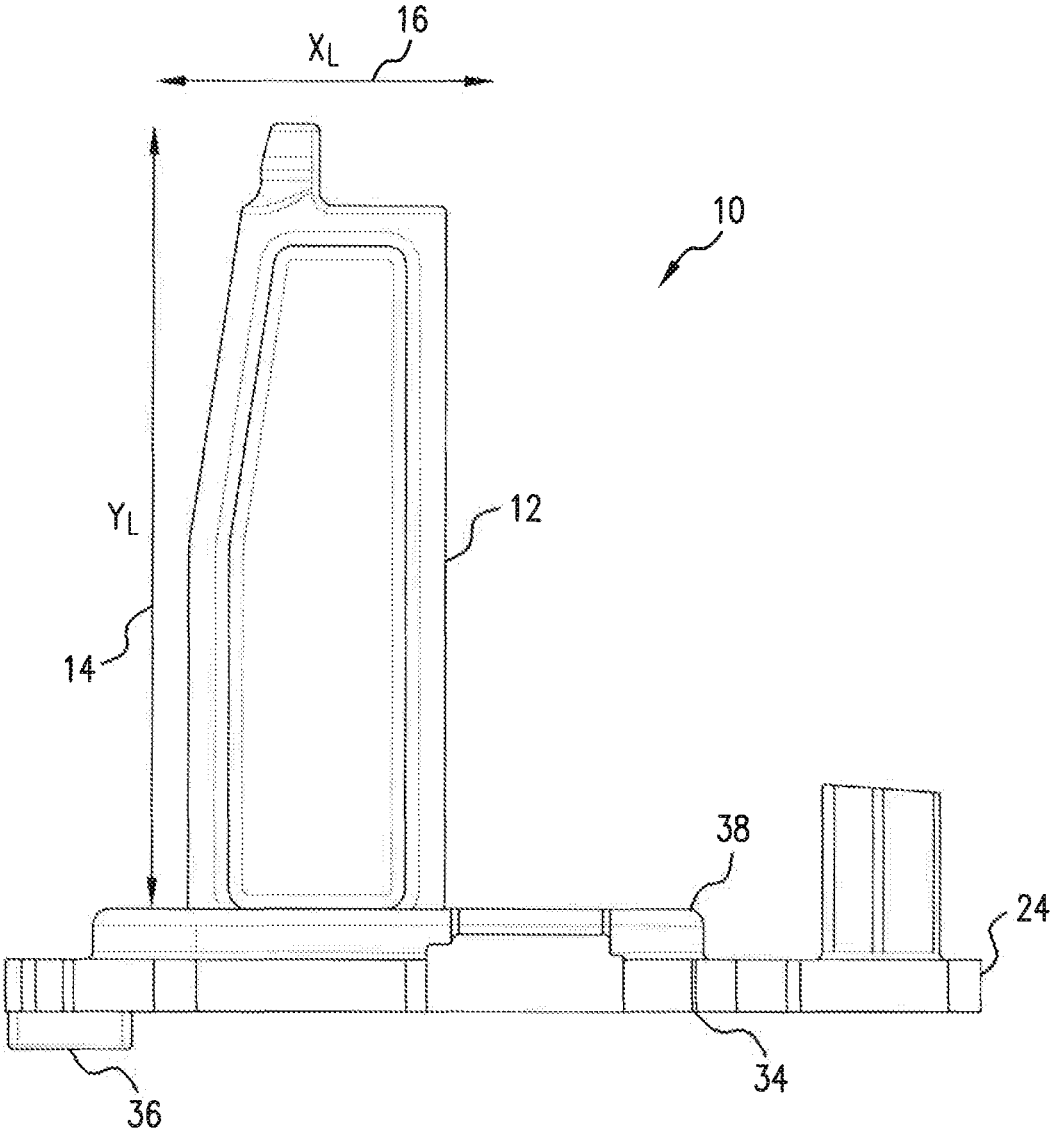
FIG. 3 is an elevational view of the limiter that forms part of the invention.
Figure 4:
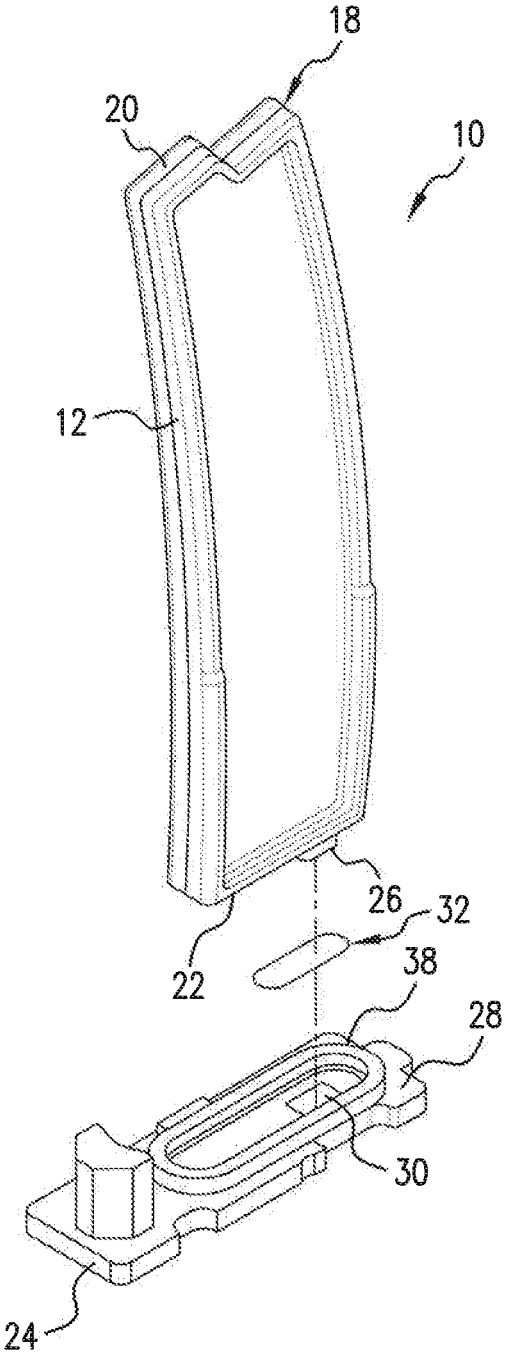
FIG. 4 is an exploded view of a limiter of the invention.

The invention described herein includes capacity limiting assemblies to provide modification of a box magazine to limit its cartridge capacity, box magazines fitted with such assemblies and methods limiting the capacity of a box magazine. The assembly as described herein can be applied to a box magazine in such a manner that the capacity reduction of the magazine is substantially irreversible. By "substantially irreversible" it is meant that the assembly cannot be removed from the magazine by an average firearms user without significant effort and/or commercial scale tools or equipment without rendering the magazine so damaged as to be useless. By "reduced capacity" or "limited capacity", it is meant that use of the assembly reduces the number of cartridges that can be inserted into the magazine.

The assembly of the invention is designed to be fitted within a magazine. As is known to persons of skill in the art, the dimensions of magazines may differ depending on the firearm in which it is to be used, the manufacturer and/or other factors. The assembly is adaptable to various magazines, including tubular and integral magazines. For convenience, the assembly is described herein in the context of a generic box-type detachable magazine.

In the exemplary context of a detachable box magazine, the assembly of the invention includes a limiter that includes at least a limiter body and a lock plate or floor plate.

With reference to FIGS. 1 to 6, the capacity limiter 10 includes a limiter body 12. The limiter body 12 has a vertical dimension ($Y_L$) 14 and a horizontal dimension ($X_L$) 16. As understood to a person of skill, these dimensions will vary depending on the size of the magazine 100 for which the assembly is prepared, e.g., the dimensions of the interior area 110 defined by the coils 112 of the specific magazine spring 104 and the dimensions of the magazine housing 102.

Figure 5:
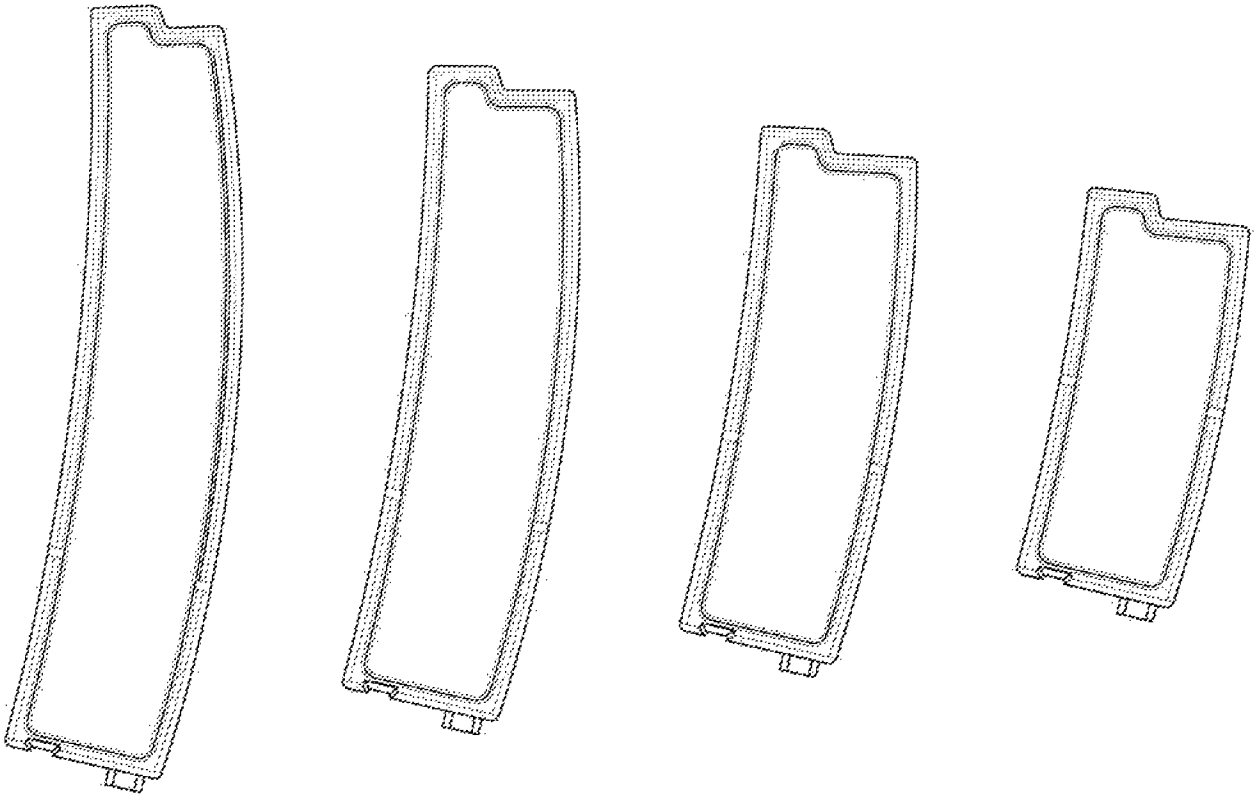
FIG. 5 is a side view of several limiter bodies, each configured to restrict a magazine by 25 rounds, 20 rounds, 15 rounds and 10 rounds, respectively.

Regardless, in the inventive assembly the vertical dimension 14 of the limiter body 12 is always less than the vertical dimension 108 of the magazine housing 102; the relationship between the two dimensions will vary as desired and provides the limiting capacity of the assembly. See, FIG. 5, showing limiters devised for a variety of capacities. For example, if one wished to restrict a magazine to five cartridge rounds, one would design the assembly so that the difference in linear measurement between $Y_M$ and $Y_L$ would equal the space necessary to insert 5 cartridge rounds.

In various embodiments without limitation, one may construct the assembly so that the vertical dimension of the limiter $Y_L$ is about 10% to about 90% less than the vertical dimension $Y_M$ of the magazine housing, about 30% to about 70% less than the vertical dimension $Y_M$ of the magazine housing and/or about 40%, about 50%, and/or about 60% less than the vertical dimension $X_M$ of the magazine housing 102 itself.

In the context of the exemplary limited capacity magazine 100 shown herein, the magazine 100 includes a magazine spring 104 that is vertically disposed within the magazine reservoir 118 defined by the magazine housing 102. The magazine spring 104 contains as many coils 112 as may be necessary to provide a biasing force to feed cartridges from the specific magazine. For example, in a smaller magazine designed for small sized cartridges, the magazine spring may include lesser coils and vice versa. In general, it may be preferred that the magazine spring contains at least 1-33 coils, in some embodiments, at least 10 coils.

The magazine spring 104 is engaged to the follower 106 so that when the spring is biased (contracted) by insertion of cartridges, it provides a pushing force against the follower. In the embodiment shown, a distal end 120 of the magazine spring 104 is attached to the lower surface 114 of the follower 106 by two clips (not shown) extending from the lower surface 114.

However, in an embodiment, the magazine spring needs only to be operatively associated with the follower such that it provides a "push" to the follower to facilitate exit of the cartridge rounds from the magazine. In such embodiment, it may float in position between the follower and the lock plate or floor plate. No direct mechanical attachment or connection is necessarily required between the spring and any other component. In this embodiment, the proximal end 134 of the magazine spring 104 is engaged to the lock plate 24.

This is optional—the spring must only be operatively associated with the lock plate—in many embodiments, for example, the spring merely resting against the lock plate. In the embodiment of the Figures, the upper surface 28 of the lock plate 24 includes a spring securement element 38 that extends from the upper surface 28. The spring securement element 38 has an outer perimeter dimensions to correspond to a 'loop' of one coil of the spring 104. The proximal end 134 (i.e., the equivalent of approximately one coil) of the spring 104 is wound around the outer perimeter approximately to secure it to the lock plate. Other manners of engaging the ends of the spring to the relevant component part may also be used, if engagement or connection is desired.

The limiter body 12 is sized and configured to be disposed within coils 112 of the magazine spring 104, that is, more than 90% of the limiter body 12 is sited within an interior coil area 110 defined by the coils 112 of the magazine spring 104. See, FIG. 2, cross sectional view taken at section A-A of FIG. 1. The relative dimensions of the limiter body $X_L$ and the area 110 defined by the coil 112 may be any desired as long as the spring's action to push the follower is not significantly impeded.

The limiter body has a top edge 18 that is designed to be engaged with the follower 106, preferably the lower surface 114 of the follower 106. As an example, in the embodiment shown in the Figures, the top edge 18 includes an extension 20 that engages with a corresponding slot (not shown) defined by the lower surface 114 of the follower 106 to facilitate smooth and reliable feeding of the cartridges. Other mechanisms by which the follower and the limiter can be engageably attached are well known in the art and are also contemplated as useful in the practice of the assembly.

Continuing with FIGS. 1 to 6, the limiter includes a lock plate 24 that engages the limiter body 12. In various embodiments, this engagement is substantially irreversible. In the embodiment shown herein, the limiter body 12 includes a bottom edge 22. The edge 22 bears a tab 26 that extends from the edge and is inserted into a corresponding hole 30 defined by the upper surface 28 of the lock plate for stability. Additionally, the edge 22 of the limiter body 12 is bonded to the upper surface 28 using a bonding agent 32. Any other manner of irreversibly securing the lock plate and the limiter body made by user.

The specific type of bonding agent 32 selected may be any known or to be developed in the art that provides a substantially permanent or irreversible bond between the material of the lock plate and the floor plate. As an example, when the plates are each formed of a thermoplastic, the bonding agent may be a polyamide polymer adhesive or epoxy. In an embodiment, the lock plate may be formed unitarily with the limiter body, if desired. In the case of such embodiment, there is no additional bonding agent needed.

When the assembly is in the magazine, a bottom surface 34 of the lock plate 24 is disposed against and adjacent to the interior surface 124 of the floor plate 122. In the embodiment shown, a sidewall 126 extends from the interior surface 124 of the floor plate 122 allowing for the reversible slidable engagement of the floor plate 122 to the bottom edge 128 of the magazine housing 102 to close or provide access to the magazine reservoir 118. In the embodiment shown herein, the bottom surface 34 of the lock plate 24 includes a button 36 that extends from the bottom surface and is insertable into a corresponding cavity 130 that is cut through the floor plate 124.

In the embodiment illustrated, when the magazine and assembly are assembled, the floor plate is bonded or otherwise affixed in a substantially irreversible manner to the magazine body and is not removeable. In an embodiment, the floor plate may be welded, melt bonded, cured and/or fusion bonded to the magazine body.

In various embodiments, the lock plate is optional; the limiter may be constructed as part of the floor plate.

Figure 6:
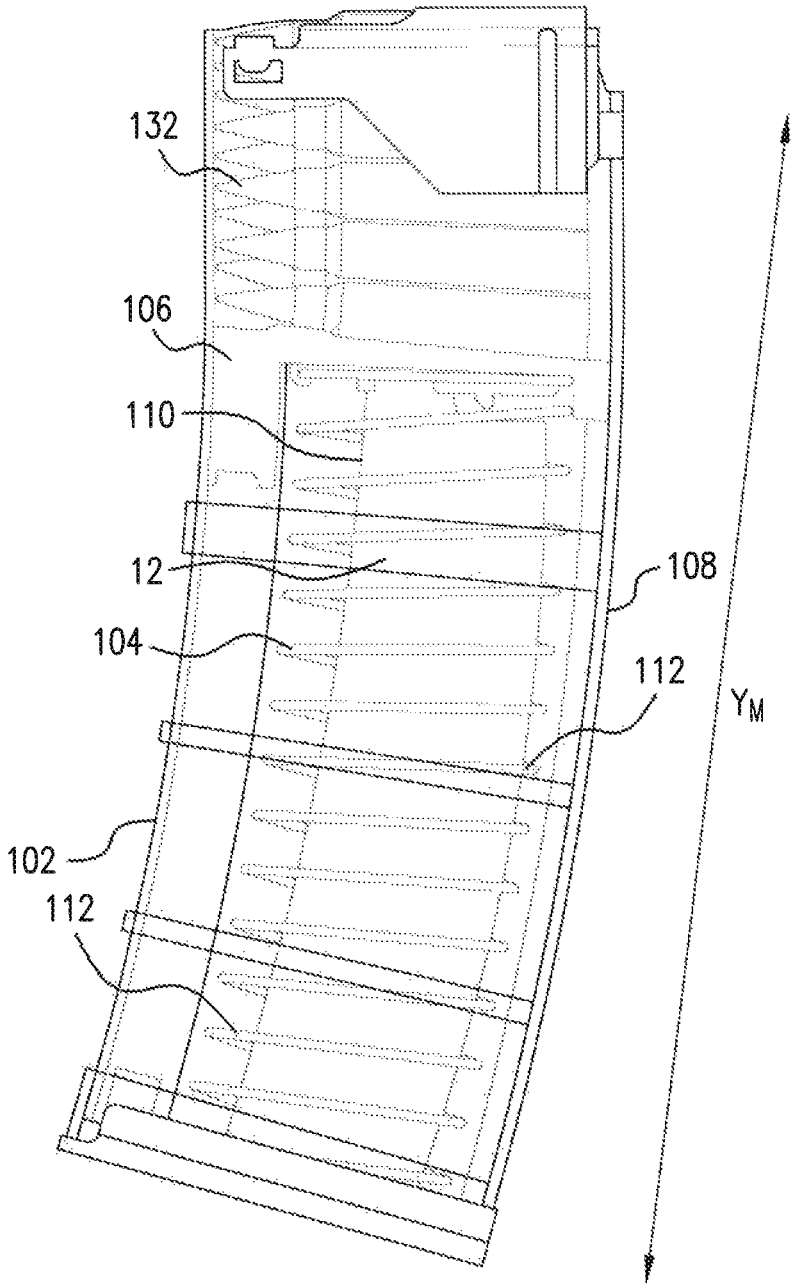
FIG. 6 is a representation of an assembled limited capacity magazine (side view) having a reduced capacity of 10 rounds.

FIG. 6 shows a side view of a reduced capacity magazine 100 of the invention containing 10 cartridge rounds 132. In this embodiment, the magazine housing 102 is translucent polymer, making visible the limiter body, the follower 106, the magazine spring 104, the floor plate 122, and the cartridge rounds 132.

Figure 7:
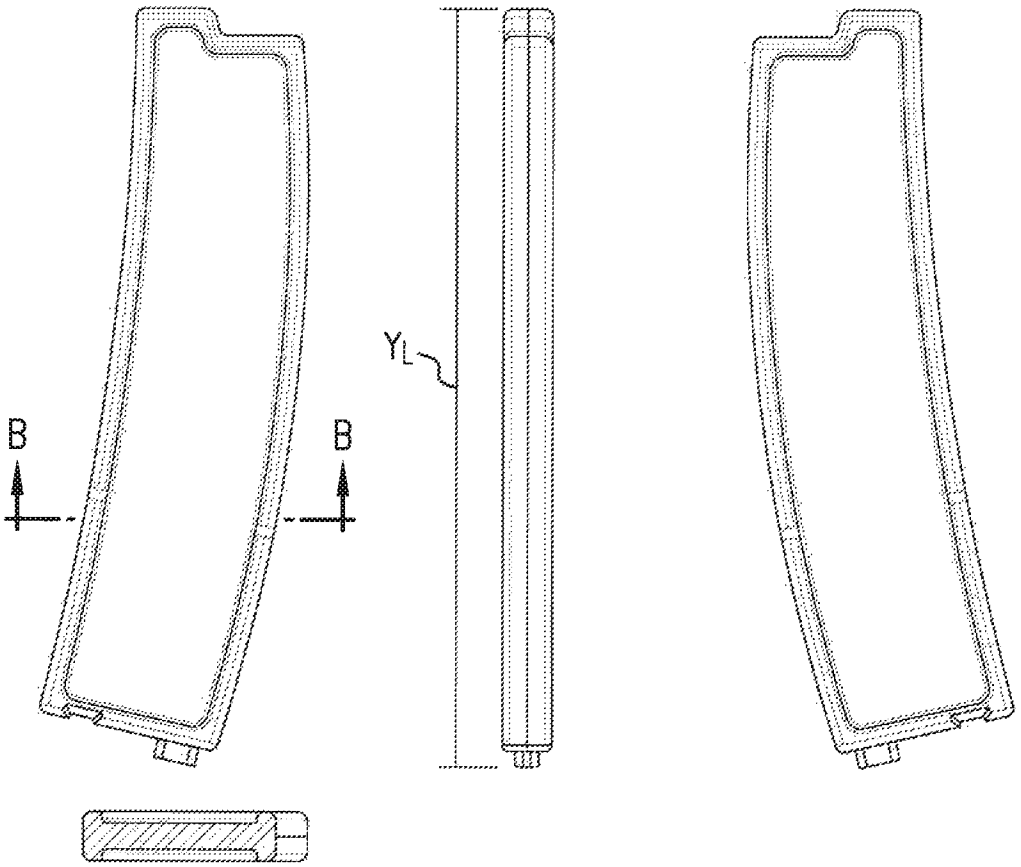
FIG. 7 includes a front view, back view and bottom view of an exemplary cartridge housing in an embodiment of the invention.

FIG. 7 shows several views (right and left side and front) of the limiter body of the invention, including a cross section view taken at B-B.

Also included in the invention are methods of reducing the capacity of a magazine by fitting it with an embodiment of the assembly described herein.

Any of the component parts described herein may be independently fabricated from any materials developed or presently in the art, for example, polymers, resins, fiberglass, metals, coated materials, and the like. In some embodiment, it may be preferred that the material(s) selected are rigid to discourage attempts to disassemble and/or to increase durability. Any of the component parts described herein, if attached or connected to one another, may be attached/connected by any means, e.g., mechanical connections, adhesives, bonding, welding, fusion bonding, melt bonding, co-curing, etc.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A capacity limiting assembly that provides substantially irreversible alteration to limit cartridge capacity of a box magazine including a magazine housing with a vertical dimension $Y_M$, a magazine spring having at least one coil, and a follower, wherein the capacity limiting assembly comprises:

a limiter body having a top edge and a bottom edge, the top edge of the limiter engageable with a bottom surface of the follower that is operatively associated with a top of the magazine spring extending into the cartridge reservoir, wherein the limiter body is configured to be disposed substantially within the at least one coil of the magazine spring, and the limiter body has a vertical dimension $Y_L$, that is less than the vertical dimension $Y_M$ of the magazine housing; and a lock plate having a top surface engageable to the bottom edge of the limiter body and a bottom surface engageable to a floor plate of the magazine housing when the floor plate is placed against a bottom edge of the magazine housing, wherein a bottom edge of the limiter body has a tab that extends from the bottom edge of the limiter body and which is insertable into a hole defined by an upper surface of the lock plate;

wherein, when a top surface of the lock plate is bonded to the limiter body, the limiter substantially irreversibly reduces the capacity of the box magazine.

2. The assembly of claim 1, wherein the vertical dimension of the limiter is about 10% to about 90% less than the vertical dimension of the magazine housing.

3. The assembly of claim 1, wherein the vertical dimension of the limiter is about 30% to about 70% less than the vertical dimension of the magazine housing.

4. The assembly of claim 1, where the magazine spring has at least 10 coils.

5. The assembly of claim 1 wherein the lock plate is bonded to at least one of the limiter body and the floor plate of the magazine housing by an adhesive.

6. The assembly of claim 1 wherein the limiter is made of a rigid material.

7. A box magazine of limited capacity comprising a magazine housing having a vertical dimension $Y_M$ and at least a first, a second and a third sidewall defining a cartridge reservoir;

a magazine spring having at least one coil disposed within the cartridge reservoir;

a follower that is operatively coupled to a top of the magazine spring, and a floor plate having a top surface operatively connected to a bottom of the magazine spring; and a cartridge capacity limiter comprising a limiter body with a vertical dimension $Y_L$, wherein the limiter body is disposed substantially within the coils of the magazine spring and has a top edge engageable with a bottom surface of the follower; and a lock plate, wherein a bottom of the limiter body is bonded to an upper surface of the lock plate and the top surface of the floor plate is disposed adjacent to a bottom surface of the lock plate, wherein the vertical dimension of the limiter body is less than the vertical dimension of the magazine housing, and when the upper surface of the lock plate is bonded to the bottom surface of the limiter body, the cartridge capacity limiter substantially irreversibly reduces the capacity of the box magazine.

8. The magazine of claim 7, wherein the vertical dimension of the limiter body is about 10% to about 90% less than the vertical dimension of the magazine housing.

9. The magazine of claim 7, wherein the vertical dimension of the limiter body is about 30% to about 70% less than the vertical dimension of the magazine housing.

10. The magazine of claim 7, where the magazine spring has at least 10 coils.

11. The magazine of claim 7, wherein the lock plate is bonded to at least one of the limiter body and the floor plate of the box magazine by an adhesive.

12. A method of substantially permanently reducing the capacity of a magazine comprising fitting a magazine with the assembly of claim 1.

* * * * *